United States Patent [19]

Demopoulos

[11] Patent Number: 4,503,893

[45] Date of Patent: Mar. 12, 1985

[54] DISC TYPE WOOD CHIPPER KNIFE HAVING POSITIONING SERRATIONS AND INTERMEDIATE LAND THEREBETWEEN

[75] Inventor: Dino M. Demopoulos, Wausau, Wis.

[73] Assignee: Murray Machinery, Inc., Wausau, Wis.

[21] Appl. No.: 497,832

[22] Filed: May 25, 1983

[51] Int. Cl.[3] ..... B27C 7/10; B02C 18/18

[52] U.S. Cl. ..... 144/176; 144/241; 241/92; 241/292.1

[58] Field of Search ..... 241/92, 292.1, 292, 241/298; 144/162 R, 176, 218, 230, 241; 407/45, 95, 96

[56] References Cited

U.S. PATENT DOCUMENTS 2,453,464 11/1948 Sheridan ..... 407/95
4,349,057 9/1982 Bachmann et al. ..... 407/45
4,351,487 9/1982 Haller et al. ..... 241/92
4,423,758 1/1984 Haller et al. ..... 144/176

*Primary Examiner*—W. D. Bray
*Attorney, Agent, or Firm*—James E. Nilles; Thomas F. Kirby

[57] ABSTRACT

A knife assembly for a disc type wood chipper for cutting wood chips from a log, for example, comprises a pair of knife holding means between which a multi-section two-edged reversible knife and an associated counter knife are releasably clamped. One surface of the knife has two spaced apart sets of indented (female) serrations with an intermediate land between the sets which engage two spaced apart sets of protruding (male) serrations and a corresponding land on one surface of the counter knife to ensure proper knife alignment. The counter knife is adjustably positionable relative to the knife holding means.

8 Claims, 7 Drawing Figures

FIG. 4
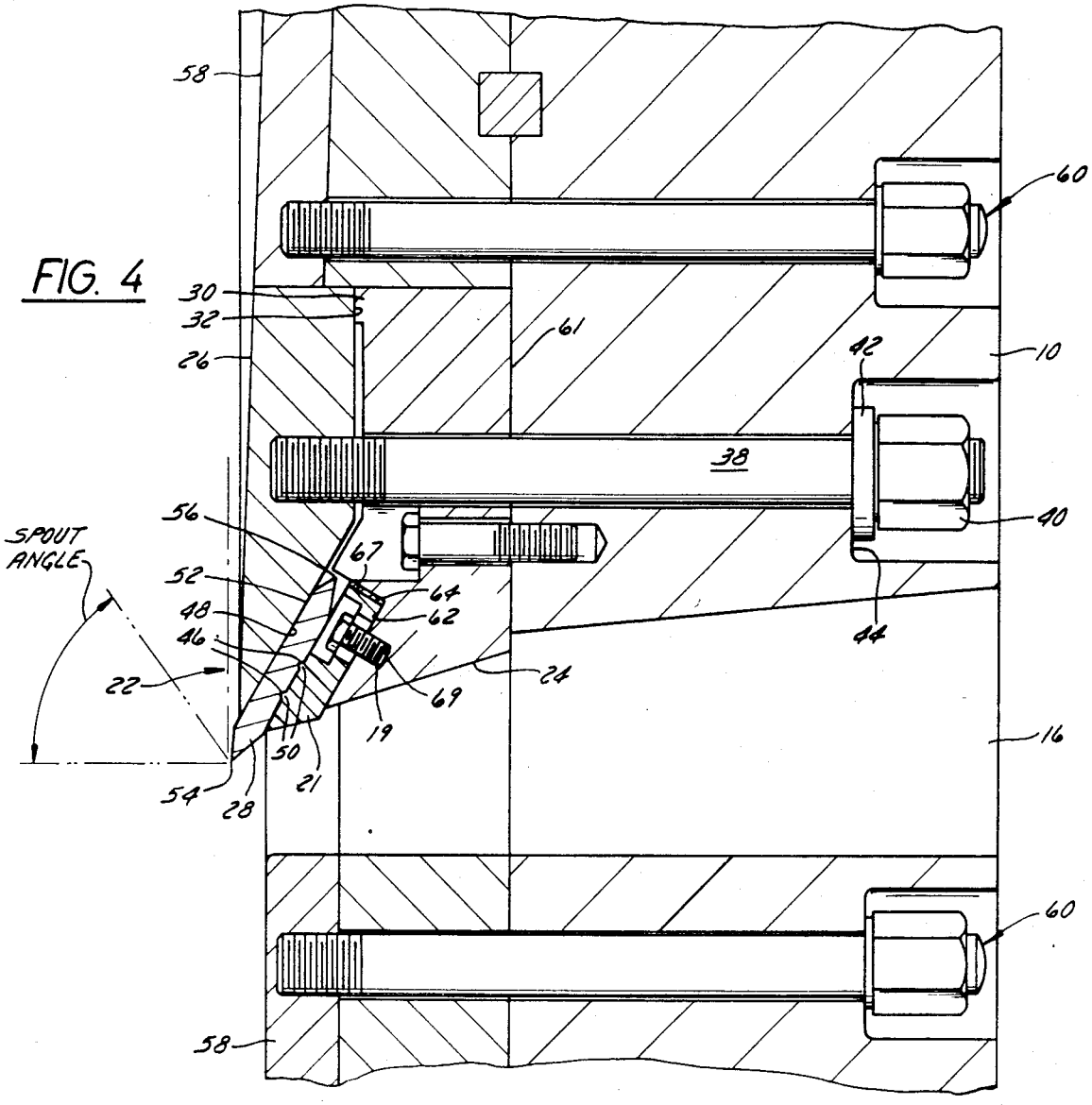
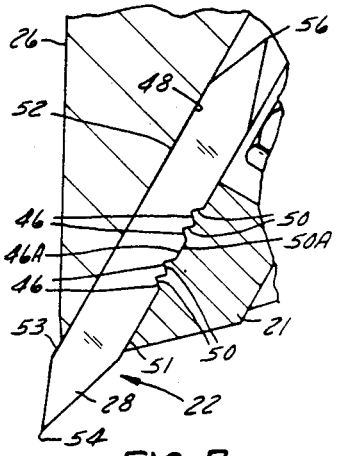
FIG. 7
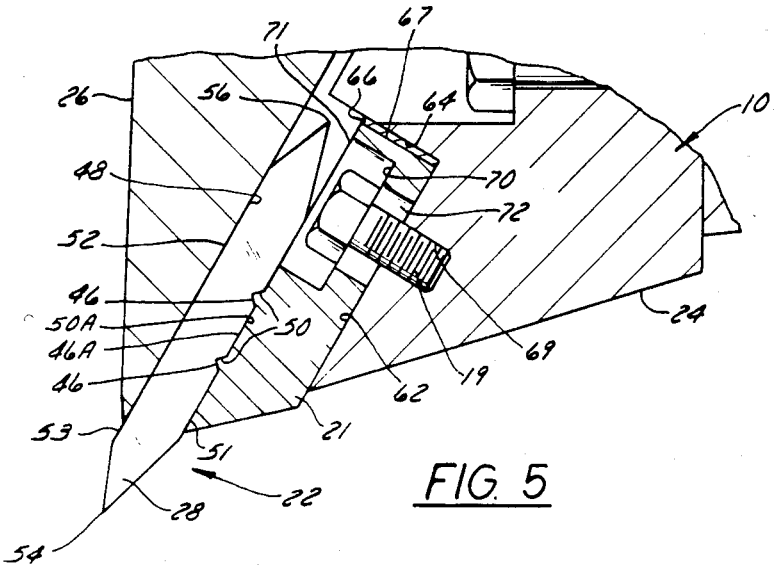
FIG. 5

DISC TYPE WOOD CHIPPER KNIFE HAVING POSITIONING SERRATIONS AND INTERMEDIATE LAND THEREBETWEEN

BACKGROUND OF THE INVENTION

1. Field of Use

This invention relates generally to material chopping devices, such as disc type wood chippers. In particular, it relates to a knife assembly for use therein in which the knife is positionable relative to the knife holding means by positioning serrations and an intermediate land therebetween.

2. Description of the Prior Art

U.S. patent application Ser. No. 187,164 entitled KNIFE ASSEMBLY FOR CHOPPING APPARATUS filed Sept. 15, 1980, by Jack R. Haller and William M. Haselton, issued Sept. 28, 1982 as U.S. Pat. No. 4,351,487 and assigned to the same assignee as the present application discloses a knife assembly for use in a chopping apparatus, such as a wood chipper, of the type having a rotatable disc and an opening therethrough to permit passage of the chopped material through and away from the disc. The assembly comprises a pair of knife holding means including a knife seat and a knife clamp or cover, for engaging a reversible knife with two cutting edges. Means are provided to ensure proper alignment of the knife and its knife holding means. Thus, one of the knife holding means has a flat knife engaging surface for cooperatively engaging a complementary flat surface of the knife. The other knife holding means has either an arcuate protrusion for cooperatively engaging an arcuate groove in the knife, or an arcuate groove cooperating with the groove in the knife to define a space for accommodating a rod which prevents relative blade movement. However, this knife assembly does not permit the position of the knife edge to be adjusted or changed relative to the knife holding means. Such change in position may be necessary after a knife has been sharpened a sufficient number of times to significantly change its dimensions. Or, such change in position might be desirable to alter the size of the chips being cut or to accommodate the nature of the material being cut. Minor adjustments are also desirable to accurately align all adjoining knife edges in a true vertical plane of rotation for closer running clearances between the disc knives and the stationary anvil or base knives, thus producing a product of more uniform size with more cleanly sheared surfaces.

U.S. Pat. No. 3,559,705 issued Feb. 2, 1971, to Louis Salzmann, Jr., for CHIPPER KNIFE AND KNIFE MOUNTING FOR DRUM TYPE WOOD CHIPPER discloses a reversible symmetrical knife for a drum type wood chipper. Such knife is extremely short in length, as compared to the knives used in disc type chippers, and the cutting edge thereof moves in a circular plane, as compared to the flat plane in which the knife cutting edge moves in a disc type chipper. Furthermore, in the structure shown in U.S. Pat. No. 3,559,705 a holder is secured to the inner surface of a drum wall by means of a screw. The head of the holder has a serrated surface which engages the serrated surface of the knife and the knife is secured to the head by means of a screw. In the aforesaid structure, forces acting on the knife as the latter cuts are ultimately transferred as shear forces to the screw through the block and to the other screw through the holder. Although there is a direct transfer of force from the knife to the block and a transfer of force from the knife to the holder through the serrations, there is no direct face-to-face transfer of force from the block to the holder or from the holder to the drum wall. Such an arrangement is tolerable in a drum type chipper wherein the knives are very short but is not acceptable strengthwise in a disc type chipper wherein the knives are quite long and encounter greater forces for a longer time interval during chipping.

U.S. patent application Ser. No. 352,246 entitled DISC TYPE WOOD CHIPPER KNIFE HAVING POSITION ADJUSTING SERRATIONS filed Feb. 25, 1983, by Jack R. Haller and Dino M. Demopoulos, issued Jan. 3, 1984 as U.S. Pat. No. 4,423,758, and assigned to the same assignee as the present application discloses apparatus for chopping material, such as logs. Such apparatus comprises a rotatable disc and at least one radially disposed opening extending through the disc and a knife assembly comprising first knife holding means attached to the disc and adjacent the opening and second knife holding means mounted on the first knife holding means. The first knife holding means comprises a knife seat secured to the disc by screws and a counter knife secured to the knife seat by other screws. The counter knife has a first knife-engaging portion including protruding serrations thereon. The second knife holding means has a second knife-engaging portion including a flat knife-engaging surface. A reversible knife having two cutting edges is mounted between said first and second knife holding means. The knife has a complementary flat surface for cooperatively engaging the flat knife-engaging surface of the second knife holding means. The knife has indented serrations for cooperatively engaging the protruding serrations. Clamping engagement means are provided for clampingly engaging the knife between the counter knife of the first knife holding means and the second knife holding means. The clamping engagement means comprises studs with two ends. Each stud has one of the ends fixed to the second knife holding means and the other of said ends is threaded. The threaded end is threadably engaged to a nut abutting the rotatable disc, whereby rotation of the nut causes axial movement of the stud therealong and permits relative movement between the first knife holding means and the second knife holding means.

The counter knife is secured to said knife seat by securement means, such as the aforesaid other screws, which enables the counter knife to be adjustably positioned relative to the knife seat.

In one embodiment the knife has the same number of indented serrations as there are protruding serrations on the counter knife whereby the knife and the counter knife can assume only one position relative to each other and there is no possibility of knife position error when a knife is installed.

In another embodiment the knife has a larger number of indented serrations when there are protruding serrations on the counter knife whereby the knife and the counter knife can assume a plurality of positions relative to each other to further enhance knife position adjustability.

The serrations disclosed are triangular in cross-section but could take some other form. Knife position gauge means are provided on the inner most end of each knife seat.

A disc type chipper in accordance with U.S. Pat. No. 4,423,758 offers several advantages over the prior art. For example, the configuration and arrangement of the components including the disc, the knife seat, the knife cover, the counter knife and the knife, as well as the cap screws and studs, provides a substantially stronger arrangement than in prior art chippers and provides for transfer of forces between the surfaces of components rather than merely through the studs and cap screws. Furthermore, the knife, when interlockingly engaged with the counter knife, is adjustably positionable in response to positioning of the counter knife on the knife seat, the positioning means therefor including cap screws and shims. In one embodiment, the arrangement of serrations on the knife and counter knife is such that the knife can only assume one position with respect to the counter knife and this arrangement provides for an even range of adjustments of knife positioning. The combination of movement of the knife on the serrations and the fine adjustment of the counter knife by use of shims provides an infinitely adjustable knife projection for very accurate alignment of all adjoining knife edges and subsequent closer running clearance adjustment of the disc knives and the stationary anvils or base knives. In addition, the counter knife serves as the point of maximum wear and, being a relatively small piece, is substantially cheaper to replace when worn than is the larger knife seat in some prior art apparatus.

When the chipper of U.S. Pat. No. 4,423,758 is in operation, the average cutting velocity at the centerline of the knife is approximately 7,000 feet per minute. Rim speed at the periphery of the disc can reach 10,500 feet per minute. The total weight of the rotating mass can reach 21 tons. This combination of great mass plus high velocity makes it imperative that running clearances be maintained and all rotating parts be fastened securely. It is quite common to adjust the chipper so that the running clearance between the disc knives and the base knives is from 0.010" to 0.030".

Knife changing is often done at night by an operator who at best is half asleep and working in a poorly lighted area. Therefore, it is essential to provide a means for locating knives that is as foolproof as possible.

The serrations shown in one embodiment in U.S. Pat. No. 4,423,758 can allow a careless operator to "cross thread" or misalign the grooves or align the male-female grooves in a tip-to-tip position. If the operator then tightens the knife cover stud nuts while the knife is in improper position, he may damage the serration tips and, if he is inattentive, he can mistakenly assume the knife is properly located. Since one can use 3,000 pounds per linear inch as the clamping force to secure the knives, considerable deformation of the serrations can take place.

In practice, a set of 2 or 3 short knives are used to make up a full knife length. If one of the knives in a set is misaligned, it may prevent the other knives in the set from being properly clamped. The same can occur if one of the knives does not receive its full portion of the clamping pressure due to the misalignment of the adjoining knife.

A misaligned knife may eliminate the necessary running clearance, strike the base knives and damage may occur. This may be anything from a broken knife to a severely damaged chipper and injury or death to personnel.

SUMMARY OF THE INVENTION

In accordance with the invention there is provided improved apparatus for chopping material, such as logs, which overcomes the aforesaid and other problems. The apparatus comprises a rotatable disc and at least one radially disposed opening extending through the disc and a knife assembly comprising first knife holding means attached to the disc and adjacent the opening and second knife holding means mounted on the first knife holding means. The first knife holding means comprises a knife seat secured to the disc by screws and a counter knife secured to the knife seat by other screws. The counter knife has a first knife-engaging portion including two spaced apart sets of protruding serrations (one or two protrusions in each set) with an intermediate land therebetween. The second knife holding means has a second knife-engaging portion including a flat knife-engaging surface. A reversible knife having two cutting edges is mounted between said first and second knife holding means. The knife has a complementary flat surface for cooperatively engaging the flat knife-engaging surface of the second knife holding means. On its opposite surface the knife has two spaced apart sets of indented serrations (one or two indentations in each set) with an intermediate land therebetween for cooperatively engaging the serrations and land on the counter knife. Clamping engagement means are provided for clampingly engaging the knife between the counter knife of the first knife holding means and the second knife holding means. The clamping engagement means comprises studs with two ends. Each stud has one of the ends fixed to the second knife holding means and the other of said ends is threaded. The threaded end is threadably engaged to a nut abutting the rotatable disc, whereby rotation of the nut causes axial movement of the stud therealong and permits relative movement between the first knife holding means and the second knife holding means.

The counter knife is secured to said knife seat by securement means, such as the aforesaid other screws, which enables the counter knife to be adjustably positioned relative to the knife seat.

In the embodiment shown, the knife has the same number of indented serrations as there are protruding serrations on on the counter knife whereby the knife and the counter knife can assume only one position relative to each other and there is no possibility of knife position error when a knife is installed. The lands lie in the same planes as the surface on or in which the associated serrations are found.

The serrations disclosed are triangular in cross-section but could take some other form. Knife position gauge means are provided on the inner most end of each knife set.

A disc type chipper in accordance with the invention offers several advantages over the prior art. For example, the arrangement of sets of serrations with a land therebetween on the knife and counter knife is such that the knife can only assume one position with respect to the counter knife and this ensures that the knife is always in proper position on the disc, assuming, of course, that the counter knife is properly positioned. With the intermediate land between the serrations a wider support is provided in the serration area as the female serrations of the knife are slid across the male serrations of the counter knife when the knife is being inserted. Since it creates an irregular pattern as compared to the regular pattern of a series of serrations there is a greatly reduced possibility of the operator getting a false "feel" of the knife being in the proper position. Since the intermediate land provides a wider positive locating means when mated into the wider groove of the counter knife, the operator has a much greater feel as the knife literally jumps into position as its slides across the serrations of the counter knife. This is verified in actual comparisons in the factory and field between.

The knives and counter knives in accordance with the invention are also easier and less expensive to manufacture. The series of serrations was originally made by machining the serrations in the knife and counter knife prior to hardening by heat treatment. It was discovered that the heat treatment distorted the parts to such a degree that the serrations would interfere before proper clamping could occur. This necessitated hand lapping each piece before it could be used. To overcome this, the serrations were then ground into the hardened parts. Grinding is a much slower and more costly process. Redressing the grinding wheel as the grinding surfaces broke down was both tedious and expensive since the accurancy of the grooves in the wheel impart the accurancy of the serrations in the parts. Reducing the number of grooves alone reduced grinding wheel initial cost and maintenance. Two serrations on each side of the land allows two two-groove wheels to be mounted on a single spindle with reduced initial and maintenance costs. This invention also lends itself to purchasing rolled sections with the serrations rolled into the steel bar from which the roughly shaped knives are cut. This is particularly true if the number of grooves on each side of the land is reduced to one. A rolled section greatly reduces the manufacturing costs of the knives.

Other objects and advantages of the invention will hereinafter appear.

BRIEF DESCRIPTION OF THE DRAWINGS

FIG. 4 is a cross-sectional view of a knife and its associated counter knife engaged between the two holding means taken on line 4—4 of FIG. 1;

FIG. 5 is a cross-sectional view of the apparatus shown in FIG. 4, on an enlarged scale;

FIG. 7 is a view similar to FIG. 5 but showing another embodiment.

DESCRIPTION OF PREFERRED EMBODIMENTS

Figure 1:
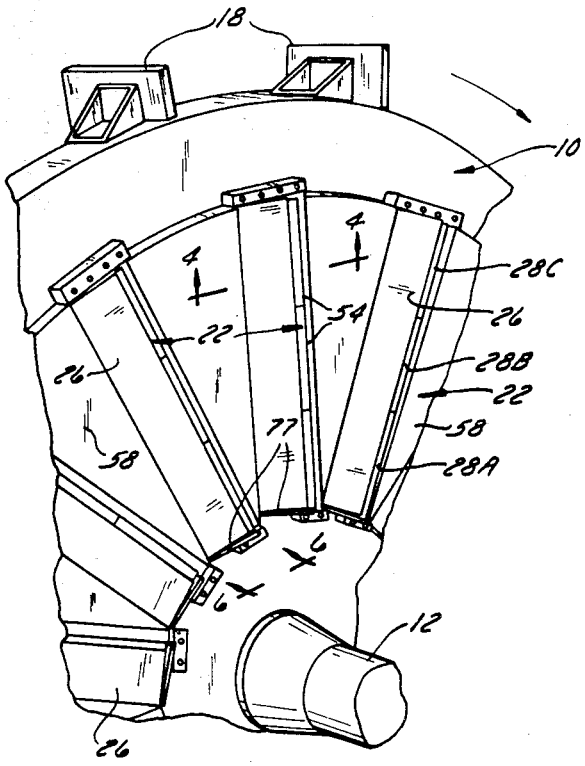
FIG. 1 is a perspective view of a part of a rotatable chopping disc of a disc type wood chipper within which the knife assembly comprising the invention is mounted.
Figure 2:
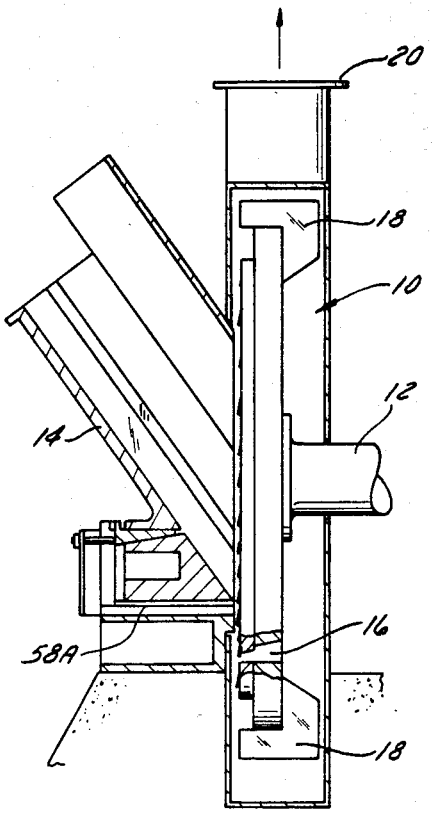
FIG. 2 is a vertical, sectional view of the chopping apparatus embodying the present invention.
Figure 3:
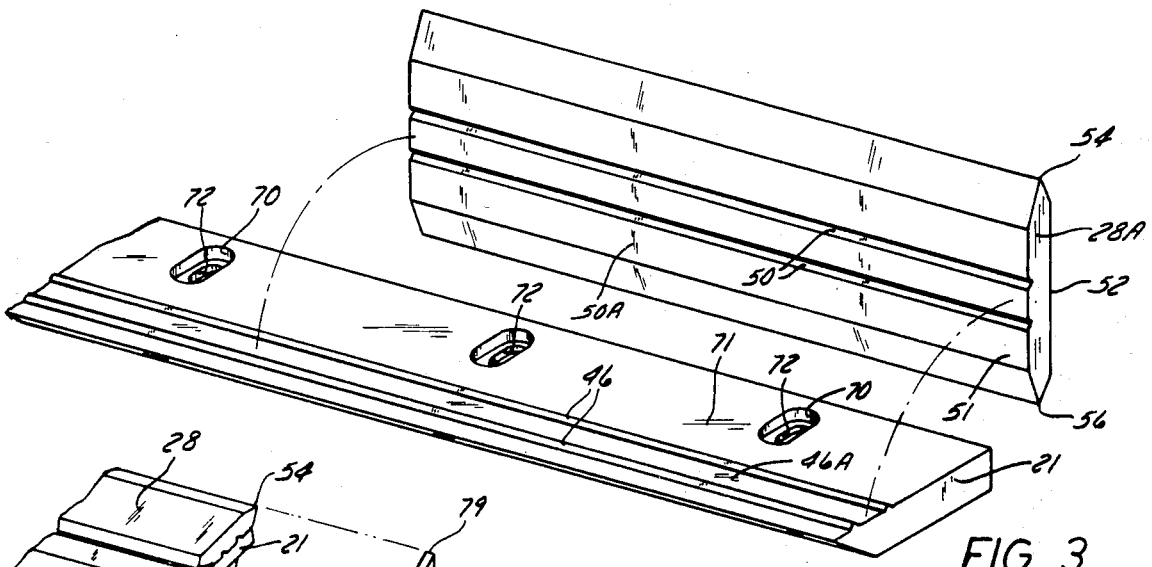
FIG. 3 is an exploded perspective view of a knife and its associated counter knife.

The knife assembly 22 described herein is typically for use in a chopping disc of a disc type wood or log chipper, as shown in FIGS. 1 and 2. The disc 10 is rotatable by a shaft 12 powered by power means (not shown). The materials to be chopped, such as logs, are fed to the disc 10 through a spout 14 angularly disposed to the axis of the disc, as defined by the shaft 12. After the wood is chopped into small pieces or chips, those chips pass through radially disposed openings 16, the details of which will be explained later, and are then swept by a plurality of paddles 18 attached to the radial ends of the disc 10 through a spout or discharge opening 20 for transfer to a remote location.

As an alternate, the chips can drop through an opening in the bottom of the chipper enclosure on to a conveyor beneath the chipper.

The knife assembly 22 includes an elongated knife seat 24 on which is mounted, by means of cap screws 19, a counter knife 21 which constitutes a first knife holding means. The assembly 22 also includes an elongated knife cover or clamp 26 which constitutes a second knife holding means, a plurality of disc knives 28A, 28B, 28C which constitute reversible knives, and means 30 for clampingly engaging the knives 28A, 28B, 28C between the first knife holding means 21, 24 and the second knife holding means 26. The knife seat 24 is attached to the disc 10 and rotates therewith, and is also adjacent the radial opening 16 by which the chopped material passes through and away from the disc 10 after being chopped by the knife assembly. The second knife holding means or clamp 26 is mounted on the knife seat 24, as may be seen in FIG. 4, where a surface 32 at the upper end of the knife cover 26 rests against an elongated support 30 of knife seat 24.

The support 30 for clampingly engaging the knife 28 between the knife seat 24 and counter knife 21 and the knife holding means 26 includes threaded studs 38, each having one end threadably engaged in the second knife holding means 26, which permits easy replacement of second knife holding means 26 when it is worn or damaged. The other end of stud 38 is threaded, and is threadably engaged to a nut 40, which abuts the disc 10 through a special washer 42. As shown in FIG. 4, the surface 32 of second knife holding means 26 is tightly abutting the adjacent support 30 of first knife holding means 24, such that no rightward movement of second knife holding means 26, with respect to first knife holding means 24 is possible, and the knife 28 and counter knife 21 are firmly engaged therebetween. Stud 38, which passes through the knife holding means 24 and into 26 and also extends through disc 10, permits relative clamping movement of knife holding means 24 and 26. Assuming right-hand threads, counterclockwise rotation of nut 40 about the threaded end to which it is engaged results in space between nut 40 and washer 42 or between washer 42 and the disc face 44 abutting that washer. This space permits leftward movement of stud 38, which in turn permits leftward movement of second knife holding means 26 relative to first knife holding means 24. Knife 28 and counter knife 21 will then no longer be tightly engaged between means 24 and 26, and thus may be readily removed to facilitate adjustment or reversal or replacement of the knife.

The counter knife 21 has a first knife-engaging portion including two spaced apart sets of protruding (male) serrations 46 (one protrusion in each set) with an intermediate land 46A between the two sets. The knife holding means or cover 26 has a second knife-engaging portion including a flat knife-engaging surface 48. In the embodiment described herein, the counter knife 21 has the protruding serrations and the second knife holding means 26 has the flat knife-engaging surface.

Each elongated knife seat 24 has attached thereto the counter knife 21 with which knife 28 is associated, which knife may be of one-piece or multiple-piece construction. A three-piece knife, each piece designated 28A, 28B or 28C being identical, is shown mounted beneath the elongated knife cover 26 of FIG. 1. Knife 28 chops material as it rotates with disc 10 by cooperative cutting action with the base knives or anvil 58A. Each knife 28 has two sides, one side 51 formed so as to include two spaced apart sets of (female) serrations 50 (one indentation in each set) with an intermediate land 50A between the two sets which accept the protruding serrations 46 and engage the land 46A. The other side 52 of knife 28 is formed flat to engage the flat knife-engaging surface 48 of clamp 26.

Each land 46A, 50A lies in the same plane as the surface of the counter knife 21 or knife 28, respectively, at which the associated serrations 46 and 50, respectively, are formed. The protruding serrations 46 integrally formed on the counter knife 21 of the first knife holding means 24 and the indented serrations 50 on knife 28 are triangular in cross-section. The number of serrations 46 equals the number of serrations 50, one of each serration (protruding or indented) being shown in each set of FIGS. 3 through 6. FIG. 7 shows an arrangement embodying two serrations per set. This illustrates the ability of the knife 28, when mounted as described, to align itself on the counter knife 21 of the second knife holding means 26 and provide good contact thereagainst. Thus, knife 28 can be placed in only one position relative to counter knife 21. The mating serrations 46 and 50 act as thrust elements.

The second side of the knife 28 comprises the complementary flat surface 52, which engages the flat knife-engaging surface 48 of second knife holding means 26. This flat surface 52, as explained hereinabove, transmits less stress per unit area to the flat knife-engaging surface 48 than any other configuration and thus permits the second knife holding means 26 to be constructed of a less expensive material than would be possible with another configuration.

Wear on knife edge 54 on knives 28A, 28B and 28C tends to be localized due to the peculiar cutting action of the chopper. Thus, any of the plurality of knives in each knife assembly may experience more wear in one area of its edge making it undesirable to keep that edge in its present position. However, the unworn portion of the knife may allow it to function satisfactorily in another position relative to the other knives in the knife assembly. Therefore, the knives may be shifted within the set relative to one another. This is done by separating the knife holding means 24 and 26 as described above and the knives are repositioned relative to one another. When edge 54 is worn out, the knife holding means 24 and 26 are separated as described above and the knife is rotated 180 degrees about an axis normal to the surface 91 of counter knife 21 so as to present edge 56 as a cutting edge. This edge may be used in different positions as described above until edge 56 is completely dull. When both edges 54 and 56 are dull the knife is removed and replaced with a new knife. The replacement knife may also be a resharpened knife. If the knife is resharpened, the counter knife 21 may be repositioned on the knife seat 24.

The apparatus is also provided with a plurality of replaceable disc wear plates 58, secured to the disc 10 with stud and nut means 60.

As FIGS. 4 and 5 show, the knife seat 24 comprises a large base surface 61 which bears against disc 10 and also comprises an outwardly facing groove which receives the counter knife 21 and is defined by the two surfaces 62 and 64 which meet at a right angle. One or more shims 66 are disposed between the rear edge surface 67 of counter knife 21 and the surface 64 of knife seat 24. The shim thickness determines the rearwardmost position of knife seat 24. Knife seat 24 is provided with threaded holes 69 for receiving the threaded ends of the cap screws 19 which secure the counter knife 21 to the knife seat 24. The heads of screws 19 are received in countersunk recesses 70 in the surface 71 of counter knife 21 and the shank of screws 19 extends through elongated slots 72 in counter knife 21. Slots 72 enables the counter knife 21 to be positioned at different distances from surface 64 of knife seat 24.

Figure 6:
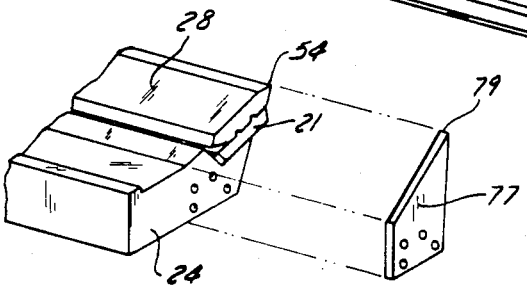
FIG. 6 is a perspective view of a gauge.

Knife position gauge means are provided to ensure that the knife 28 is located in correct position on the disc 10 relative to all other components. As is apparent, knife 28 can be held in a fixed position relative to counter knife 21 because of the interengaging serrations 46 and 50. Only one fixed position is possible. However, counter knife 21 can be placed in many positions relative to knife seat 24 because of the screw-receiving slot 72 in counter knife 21. Accordingly, knife 28 can assume several possible positions, only one of which is correct relative to knife seat 24, knife position gauge means are provided to ensure placement of the knife in that position. As FIGS. 1 and 6 show, such means comprise a plate 77 which is secured as by a plurality of cap screws to the innermost end of knife seat 24. Plate 77 is trapezoidal in form and its outer point 79 defines the locus of knife edge 54. Provision of such gauge eliminates the need to measure blade position. It is to be understood that the knife position gauge means could be mounted on a component other than the knife seat and could take a form other than shown.

I claim:

1. In apparatus for chopping material, comprising a rotatable disc and at least one radially disposed opening extending through said disc, a knife assembly comprising: first knife holding means attached to said disc and adjacent said opening; second knife holding means mounted on said first knife holding means; said first knife holding means comprising a knife seat secured to said disc and a counter knife secured to said knife seat and having a first knife-engaging portion including two spaced apart sets of protruding serrations thereon with an intermediate land therebetween; said second knife holding means having a second knife-engaging portion including a flat knife-engaging surface; a reversible knife having two cutting edges and mounted between said first and second knife holding means, said knife having a complementary flat surface for cooperatively engaging said flat knife engaging surface of said second knife holding means, said knife further having a side 51 opposite said flat surface with two spaced apart sets of indented serrations thereon with an intermediate land therebetween for cooperatively engaging said protruding serrations and said land on said counter knife; and clamping engagement means for clampingly engaging said knife between the counter knife of said first knife holding means and said second knife holding means.

2. Apparatus according to claim 1 wherein said counter knife is secured to said knife seat by securement means which enable said counter knife to be adjustably positioned relative to said knife seat.

3. Apparatus according to claim 1 or 2 wherein said knife has the same number of indented serrations in each set as there are protruding serrations in a corresponding set on said counter knife.

4. Apparatus according to claim 3 wherein each set comprises one serration.

5. Apparatus according to claim 3 wherein each set comprises two serrations.

6. Apparatus according to claim 1 or 2 or 3 or 4 or 5 wherein each land is in the same plane as the surface at which a serration is formed.

7. The apparatus set forth in claim 6 further characterized in that said serrations are triangular in cross-section.

8. The apparatus set forth in claim 7, wherein said clamping engagement means comprises a stud with two ends, one of said ends fixed to said second knife holding means and the other of said ends being threaded, said threaded end being threadably engaged to a nut abutting said rotatable disc, whereby rotation of said nut causes axial movement of said stud therealong and permits relative movement between said first knife holding means and said second knife holding means.

* * * * *